US008475220B2

(12) United States Patent
Glick et al.

(10) Patent No.: US 8,475,220 B2
(45) Date of Patent: Jul. 2, 2013

(54) POWER TERMINAL

(75) Inventors: Michael Glick, Farmington Hills, MI (US); Slobodan Pavlovic, Canton, MI (US); Brantley Natter, Brighton, MI (US); David Menzies, Linden, MI (US); Rainer Busies, Wuppertal (DE); Dirk Winter, Remscheid (DE); Dirk Placzko, Wuppertal (DE)

(73) Assignee: Lear Corporation, Southfield, MI (US)

( * ) Notice: Subject to any disclaimer, the term of this patent is extended or adjusted under 35 U.S.C. 154(b) by 52 days.

(21) Appl. No.: 13/296,534

(22) Filed: Nov. 15, 2011

(65) Prior Publication Data

US 2012/0129407 A1 May 24, 2012

Related U.S. Application Data

(60) Provisional application No. 61/416,894, filed on Nov. 24, 2010.

(30) Foreign Application Priority Data

Feb. 14, 2011 (DE) ..... 10 2011 011 151

(51) Int. Cl.
*H01R 13/18* (2006.01)

(52) U.S. Cl.
USPC ..... 439/839

(58) Field of Classification Search
USPC ..... 439/839, 857, 620.26, 250
See application file for complete search history.

(56) References Cited

U.S. PATENT DOCUMENTS

| | | | | | |
|---|---|---|---|---|---|
| 4,351,583 | A * | 9/1982 | Belttary | ..... | 439/839 |
| 4,385,794 | A | 5/1983 | Lucius | | |
| 4,932,877 | A * | 6/1990 | Zinn | ..... | 439/839 |
| 5,007,865 | A | 4/1991 | Jakobeit | | |
| 5,022,868 | A | 6/1991 | Legrady | | |
| 5,094,636 | A * | 3/1992 | Zinn et al. | ..... | 439/839 |
| 5,581,225 | A * | 12/1996 | Oh et al. | ..... | 337/295 |
| 5,807,133 | A | 9/1998 | Arnett | | |
| 6,159,036 | A | 12/2000 | Daoud | | |
| 6,315,599 | B1 | 11/2001 | Daoud | | |
| 7,595,715 | B2 * | 9/2009 | Pavlovic et al. | ..... | 337/198 |
| 7,876,193 | B2 * | 1/2011 | Pavlovic et al. | ..... | 337/229 |
| 7,892,050 | B2 * | 2/2011 | Pavlovic et al. | ..... | 439/839 |
| 8,242,874 | B2 | 8/2012 | Pavlovic et al. | | |

OTHER PUBLICATIONS

Russian Office Action for corresponding Application No. 2011149194/07(073857), mailed Mar. 15, 2013, 3 pages, translation only.

* cited by examiner

*Primary Examiner* — Tulsidas C Patel
*Assistant Examiner* — Phuongchi Nguyen
(74) *Attorney, Agent, or Firm* — Brooks Kushman P.C.

(57) ABSTRACT

An electrical connector formed to have at least one or more pairs of opposing legs extending from a body portion where each leg extends to a contact point where an inner surface of each opposing leg contact. A spring clip can be positioned over one or more of the opposing legs to increase a compressive force. The spring clip may include an alignment feature to limit clip rotating and/or pitching.

16 Claims, 3 Drawing Sheets

POWER TERMINAL

CROSS-REFERENCE TO RELATED APPLICATIONS

This application claims the benefit of U.S. provisional Application No. 61/416,894, filed Nov. 24, 2010 and claims foreign priority benefits under 35 U.S.C. §119(a)-(d) to DE 10 2011 011 151.4, filed Feb. 14, 2011, the disclosures of which are hereby incorporated by reference in their entirety.

TECHNICAL FIELD

The present invention relates to terminals, such as but not limited to power terminals operable within a vehicle to support transport of high power currents.

BACKGROUND

Terminals may be constructed from copper due to its beneficial electrical conductivity properties. Copper can be susceptible to relaxation (i.e., loss of spring force) as temperatures increase. Since temperature of the terminals can increase as the current drawn in the electrical circuit increases, copper terminals may have a reduced ability to maintain strong clamping force under such conditions. In the case of the copper terminal being a female terminal constructed to provide a compressive force, this relaxation of the female terminal can decrease an overall contact area with a male blade, which may result in reduced electrical conductivity, increased resistance, and a further increase in temperature. It is typically desirable to keep the overall size of an electrical distribution box or other connectors as small as possible while still providing the necessary current-carrying capacity. Therefore, it may not be beneficial to increase compressive force by simply making the terminals thicker or wider. When copper is used, the size limitations may make the desired spring force unattainable. Copper alloys for which relaxation does not occur until higher temperatures are reached have been used typically at the cost of lower conductivity.

SUMMARY

A female terminal for an electrical connector for connecting to a male blade terminal may include at least one or more pairs of opposing beams for compressing against the male blade terminal with a first compressive force, each adjoining pair of opposing beams defining a recess therebetween and a clamping member positioned at least partially within each recess to apply a second compressive force to the adjoining pair of opposing beams, the second compressive force adding to the first compressive force to create a third compressive force, the clamping member having at least one alignment portion configured to facilitate position within the recesses.

The female terminal may include at least one alignment portion creating a wave-shape within the clamping member, the wave-shape having a trough extending below an outer surface of the adjoining pair of opposing beams.

The female terminal may include the clamping member including at least one pair of opposing legs joined at one end to a base with the wave-shape being positioned between the base and an opposite leading end.

The female terminal may include at least one alignment portion including a first set of lateral extensions extending outwardly over the outer surface of the adjoining pair of opposing beams, the lateral extensions cooperating with the wave-shape to limit pitching and rotating of the clamping member.

The female terminal may include at least one alignment portion including a lance that extends downwardly into the recess at least a first distance below an outer surface of the adjoining pair of opposing beams to limit rotating.

The female terminal may include the lance being wave-shaped.

The female terminal may include the at least one alignment portion including a first set of lateral extensions extending outwardly relative to the lance over the outer surface of the adjoining pair of opposing beams.

The female terminal may include the clamping member including at least two pairs of opposing legs joined at one end to respective bases and a cross member connecting each pair, each pair having one leg connecting to the cross member and one leg not connecting to the cross member.

The female terminal may include the opposing beams having a first metallic composition and the clamping member has a second metallic composition, wherein the first metallic composition has a higher conductivity than the second metallic composition.

The female terminal may include the second metallic composition having a higher relaxation temperature than the first metallic composition.

The female terminal may include at least two pairs of opposing beams wherein at least one of the at least two pairs of opposing beams is staggered relative to the other of the at least two pairs of opposing beams.

The female terminal may include the beams extending in the same direction from a body portion, the body portion defining a cavity between opposed top and bottom sides space apart relative to opposed lateral sides, the beams connecting exclusively to the top and bottom sides.

The female terminal may include a terminal area having top and bottom terminals extending from the body portion for connection to a conducting element, the beams, body portion, top terminal and bottom terminal being formed from a single sheet of folded metal.

The female terminal may include the top terminal being mechanically and electrically bonded to the bottom terminal with at least one of a clinch and a weld.

The female terminal may include the top and bottom terminals extending over top of each other at a right angle from the body portion defined relative to the opposing beams.

The female terminal may include the third compressive force being sufficient to cause a forward end of each pair of opposing beams to touch in the absence of the male terminal, the opposing beams not touching when subjected only to the first compressive force in the absence of the male terminal.

An electrical connector may include at least one or more pairs of opposing legs extending from a body portion, each leg having a substantially equal thickness and sloping inwardly relative to an outer perimeter of the body portion to a contact point where an inner surface of each opposing leg contact and a clip attached over an outer surface of each opposing leg to increase a compressive force between opposing legs, wherein the spring including a wave-shaped lance extending inwardly relative to an outer surface of adjoining pairs of opposing legs to limit spring clip rotation.

The female terminal may include the legs extending in the same direction from a body portion, the body portion defining a cavity between opposed top and bottom sides space apart relative to opposed lateral sides, the beams connecting exclusively to the top and bottom sides, a terminal area having top and bottom terminals extending from the body portion for connection to a conducting element, and wherein the top and bottom terminals extend over top of each other at a right angle from the body portion defined relative to the opposing beams.

An electrical connector may be formed by the process of cutting a piece of sheet metal to include an even number of legs, a body portion and a terminal portion, manipulating the flat piece of sheet metal such that opposed sides of the sheet metal come together at a fold line, each leg aligns with one opposing leg, and each leg bends inwardly from a the body portion to contact with the one opposing leg, and positioning a spring clip to apply compressive force to the opposing legs.

The connector may include forming the spring clip to include a wave-shaped portion that facilitates positioning the spring clip between the opposing legs.

BRIEF DESCRIPTION OF THE DRAWINGS

The present invention is pointed out with particularity in the appended claims. However, other features of the present invention will become more apparent and the present invention will be best understood by referring to the following detailed description in conjunction with the accompany drawings in which:

DETAILED DESCRIPTION

Figure 1:
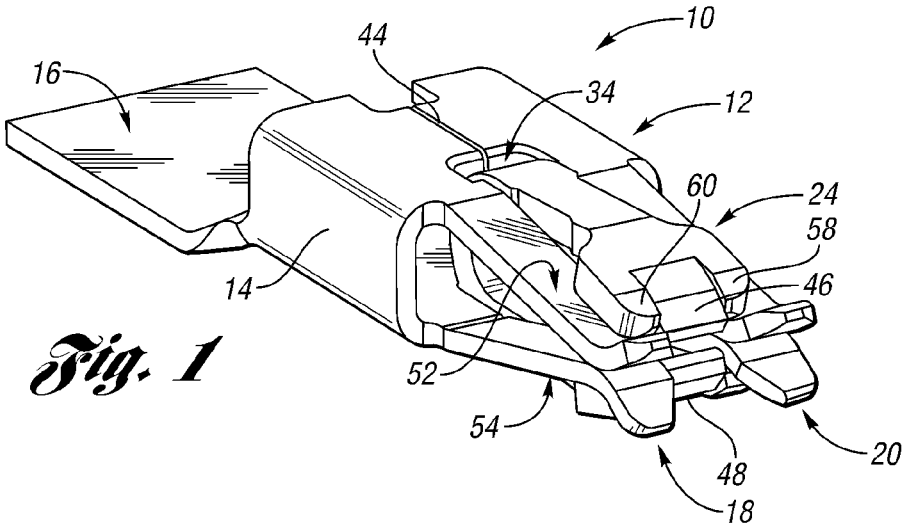
FIG. 1 illustrates a female terminal assembly in accordance with one non-limiting aspect of the present invention.
Figure 2:
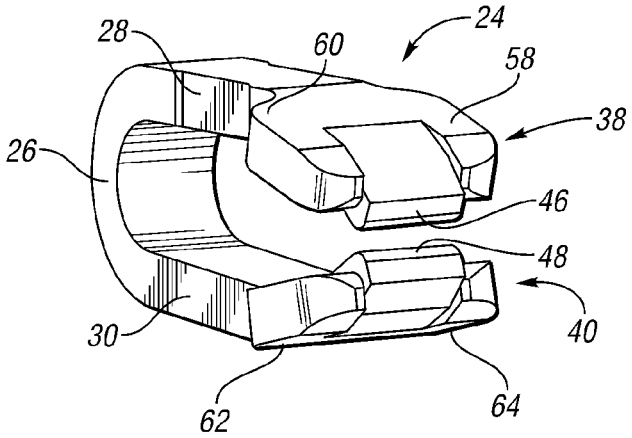
FIG. 2 illustrates a U-shaped clamping member in accordance with one non-limiting aspect of the present invention.

FIG. 1 illustrates a female terminal assembly 10 for an electrical connector for connecting to a male terminal in accordance with one non-limiting aspect of the present invention. The assembly 10 includes a terminal 12 having a body 14 formed with a termination area 16 at one end for connecting to another electrical connector or wire and a plurality of opposing beam pairs 18, at the other end for connecting to a flat, male terminal blade, such as one connected to a power distribution box included within a vehicle (not shown). The terminal 12 is shown to include first and second opposing beam pairs 18, 20 that spread apart to provide a compressive force against the blade terminal. The amount of force generated by the opposing beams 18, 20 may be increased with the use of a clamping member 24. FIG. 2 illustrates a U-shaped clamping member 24 contemplated by one non-limiting aspect of the present invention that may be fitted within the terminal 12 to increase compression on the opposing beams 18, 20.

The clamping member 24 may include a base portion 26 from which first and second legs 28, 30 extend. The clamping member 24 may be laterally disposed in a recess 34 formed between adjacent beam pairs 18, 20. Clamping member 24 may include a first and second alignment portion 38, 40 disposed over at least one of the opposing beams 18, 20 for applying a predetermined compression force. The clamping member 24 may have a metallic composition different from a metallic composition of the terminal, such as one having a higher conductivity than the second metallic composition so that the second metallic composition has a higher relaxation temperature than the first metallic composition, although this need not be the case as the two metallic compositions may be the same and/or the clamping member 24 may be comprised on a non-conducting material. The first metallic composition may consist of any desirable high conductivity material, and may preferably consist of nearly pure copper (e.g., copper C102) or copper with trace amounts of other substances (e.g., copper C151 which includes about 0.1% zirconium). The second metallic composition may consist of stainless steel, such as SS301 which includes about 17% chromium, 10% carbon, 7% nickel, and the remainder is iron.

One factor in determining an amount of insertion force required to force the terminal assembly 10 over the male terminal amount of addition force the clamping member 24 applies in addition to the opposing beam pairs 18, 20. Since the clamping member 24 provides additional compressive force to the compressive force of the opposed beam pairs 18, 20 it may be desirable to control the resulting force normal force by correspondingly selecting materials for the terminal body 14 and/or by selectively adjusting the dimensioning (length, width, angle, etc.) of the beam pairs 18, 20. The electrical capabilities of the terminal 10 may also be considered when determining the amount of desired normal force as it may be desirable to increase the insertion force, and thereby the normal force, in order to maximize current capabilities, such as to support high power operations (e.g., 80+A, 100+ VDC).

The beam pairs 18, 20, for example, may be configured to provide 4 newton (N) of normal force in the absence of the clamping member 24. Addition of the clamping member 24 may increase the normal force at the contact area to between 12-15 N. These parameters may be selectively adjusted to achieve a balance between the amount of normal force and a rise over ambient temperature (ROA) through the connection region for a given amount of current. The rise over ambient temperature may relate to an amount of current that may pass through the contact area between the beam pairs and male blade at a particular normal force before a rise in 55° C. over ambient temperature is achieved. The following table illustrates one example of such a relationship.

| Normal Force (Newton) | Current (Ampere) |
|---|---|
| 5 | 150 |
| 10 | 180 |
| 15 | 200 |
| 20 | 201 |

As shown in the table, increases in normal force allow for corresponding increases in current prior to achieving 55° C. ROA. At some point, however, the rate of increase begins to slow, which is shown to occur around 15N (this transitional point may change significantly depending on materials and the configuration, shape, etc. of the contact point). One non-limiting aspect of the present invention contemplates selecting the optimized amount of additional force applied by the spring clip 24 (clamping member) relative to the current carrying capabilities. The balancing of normal force versus current capabilities can be important as it may be desirable to use the least amount of normal force to meet current and ROA requirements while at the same time limiting the amount of insertion force. Additionally, the surface roughness of the blade and the opposed beams 18, 20 may be similarly controlled in order to reduce insertion force, such as by limiting the surface roughness to between 0.8 and 1.6 RA. Double coining or other coining processes may be used to further refine the surface roughness of the blade and beam pairs.

The beam pairs 18, 20, terminal body 14, and terminal area 16 may be made from the same piece of material. The material may include the same or varying thickness throughout (e.g., portions may be thicker or thinner to improve stability, to control forces, etc.). The material may be cut, stamped or otherwise manipulated from a solid material shaped to include recesses, reliefs, apertures, and other formations necessary to facilitate folding, bending, or other manipulating required to convert the flat piece of material into the illustrated configuration. Opposed sides of the material may be folded over toward each other such that a split or fold line 44 is formed proximate the two sides once positioned to the illustrated configuration. Once the terminal 12 is arranged into the illustrated shape, the clamping member 24 may be positioned within the recess 44 using an arbor or other device to open the clamping legs 28, 30 a distance which allows the rearward, closed end of the clamping legs 28, 30 to slide within the recess channels 34 a distance sufficient to allow the forward open ends to pass over the leading ends of the beam pairs 18, 20 such that the forward end of the clamping legs 28, 30 rest above the contact area between opposed beams 18, 20 within a V-shaped triangle.

The first and second alignment portions 38, 40 may be constructed to include lances 46, 48 to facilitate positioning within the recess 34. The lances 46, 48 may be shaped to extend downwardly below an outer surface 52, 54 of the adjoining beams into the recess 34 in order to limit rotational movement. The clamping member 24 may include additional alignment portions 58, 60, 62, 64 constructed as lateral extensions to facilitate positioning within the recess 34, either in cooperation with or in place of one or more of the lances 46, 48. The lateral extension 58, 60, 62, 64 may extend from the legs 28, 30 out over the outer surfaces 52, 54 of the adjoining beam pairs 18, 20. FIG. 2 illustrates the clamping member 24 including alignment portions on both of the legs 28, for exemplary purposes. The present invention fully contemplates any number and combination of the alignment portions being used.

The lances 46, 48 may be positioned proximate a valley of a V-shaped trough included within each beam pair 18, 20. The lances 46, 48 may extend a distance inwardly relative to the outer surfaces 52, 54 of the opposed beams 18, 20 into the recess 34. The lances 46, 48 may be approximately equal in width to the width of the recess 34 to provide a slight interference fit therebetween. The positioning of the lances 46, 48 within the recess 34 may be helpful to prevent or severely limit the clamping member from rotating. The lateral extensions 58, 60, 62, 64 may be included proximate each lance 46, 48. The lateral extensions 58, 60, 62, 64 may extend outwardly a distance sufficient to limit pitching/yawing of the spring clip 220. The lances 46, 48 and lateral extension 58, 60, 62, 64 are shown to have the same material thickness as the legs 28, 30, however, the present invention contemplates varying the size and shape thereof.

FIGS. 3*a*-5*b* illustrate top and bottom views for female terminal assemblies 70, 72, 74 where a terminal 78, 80, 82 includes an additional four sets of opposing beam pairs 86, 88, 90, 92 to facilitate connection to a second male terminal and/or to provide an additional connection to the same male terminal blade. Each terminal assembly 76, 72, 74 may be constructed and operate similarly to the terminal assembly 10 described above, at least with respect to having a similar clamping member 96, 98, 100 operable to compress the opposing beam pairs 86, 88, 90, 92 against the terminal blade. The clamping members 96, 98, 100 are shown to be each comprise of two sets of clamping legs 102, 104, 106, 108, 110, 112, 114, 116, 118, 120, 124, 126 connected on one side with a cross member 128, 130, 132. The cross member 128, 130, 132 may be used to secure the relative positioning of each set of adjoining clamping legs 102, 104, 106, 108, 110, 112, 114, 116, 118, 120, 124, 126. The cross member 128, 130, 132, however, is an optional feature that may be removed in favor of individual, i.e., non-connected, clamping members. The clamping member 96, 98, 100 is shown to be positioned on a first side of a body portion 136, 138, 140 opposite to a terminal area 142, 144, 146.

FIGS. 3*a*-5*b* illustrates various configurations for the terminal area 142, 144, 146 to which additional connections are made. The terminal area 142, 144, 146 is shown to extend opposite to the opposing beams 86, 88, 90, 92 relative to the body portion 136, 138, 140. The terminal area 142, 144, 146 may be shaped to the illustrated configuration from a flat piece of material in a stamping process or other process. Part of this process may include folding the terminal 78, 80, 82 from a flat piece of material in to the illustrated configuration so as to form the opposing beams 86, 88, 90, 92 on one side of the body portion 136, 138, 140 and the terminal area 142, 144, 146 on the other. The body portion 136, 138, 140 may be shaped to include opposed side walls 150, 152, 154, 156, 158, 160 and top and bottom surfaces 162, 164, 166, 168, 170, 172 about a cavity area 176, 178, 180. The top portion 162, 166, 170 may be configured to extend downwardly to rest against the bottom portion 164, 168, 172, resulting in formation of the terminal area 142, 144, 146. A flat clinch (FIG. 3*a*), a raised clinch (FIG. 4*a*), and/or a weld (FIG. 5*a*) may be used to mechanically and electrically connect the top and bottom portions depending on the desired surface contours.

Figure 6:
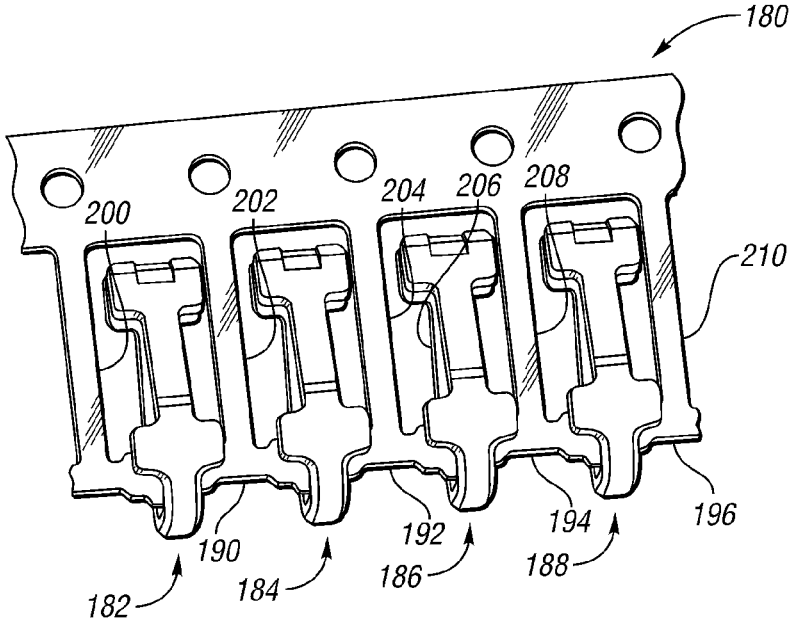
FIG. 6 illustrates clamping sheet in accordance with one non-limiting aspect of the present invention.
Figure 3B:
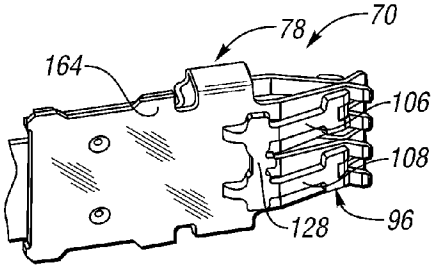
FIGS. 3*a*-5*b* illustrate female terminal assemblies in accordance with non-limiting aspects of the present invention.
Figure 4B:
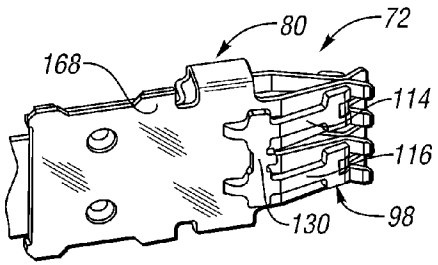
Figure 5B:
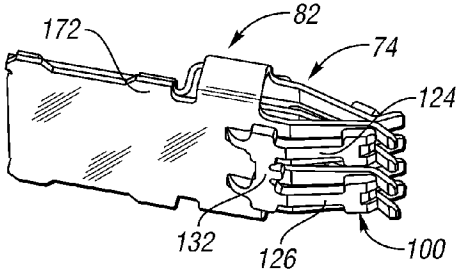
Figure 3A:
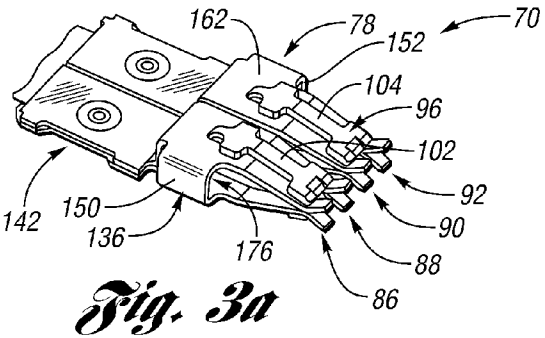
Figure 4A:
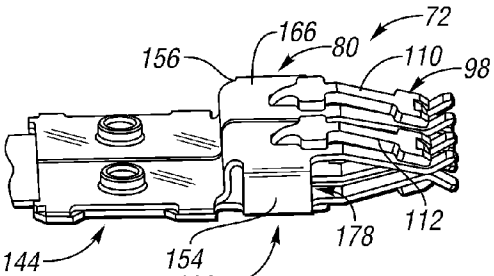
Figure 5A:
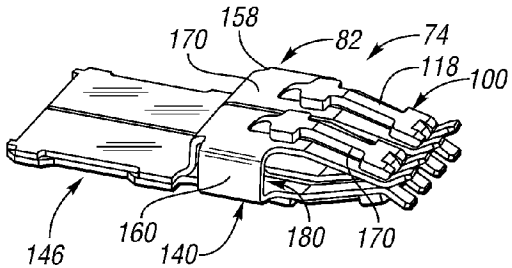

FIG. 6 illustrates a sheet 180 of clamping, leg pair members 182, 184, 186, 188 from which the above-noted clamping member may be cut in accordance with one non-limiting aspect of the present invention. The clamping leg pairs 182, 184, 186, 188 may be manufactured in a process in which each clamp leg is initially formed and then shapted into the illustrated U-shapes. The material, or more particularly the cross members 190, 192, 194, 196 and section bars 200, 202, 204, 206, 208, 210, may be cut at desired intervals to form clamping members having any number of sets of opposed clamping legs to facilitate assembly whereby rolls or sheets of clamping members may be delivered prior to cutting. The desired number of clamps may then be cut from the roll depending on the particular configuration of the corresponding terminal. Of course, the present invention is not intended to be limited to U-shaped clamping members or the formation of clamping members according to the noted manufacturing process as the present invention fully contemplates molding or other manufacturing processes.

Figure 7:
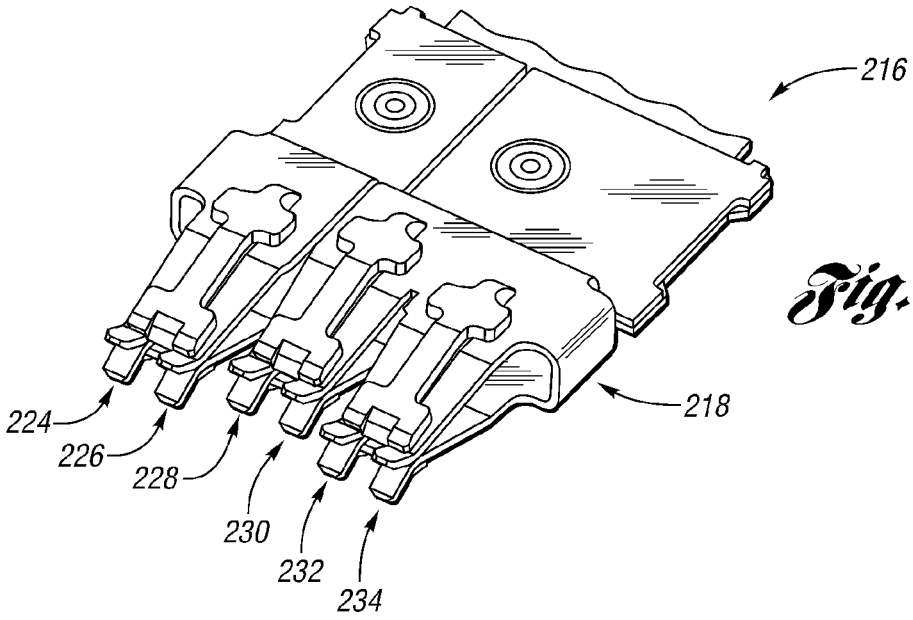
FIG. 7 illustrates a staggered terminal assembly in accordance with one non-limiting aspect of the present invention.

FIG. 7 illustrates a terminal assembly 216 where a terminal 218 includes pairs of opposing beams 224, 226, 228, 230, 232, 234 arranged in a staggered configuration. The amount of insertion force can become more critical as the number of beam pairs 224, 226, 228, 230, 232, 234 increases as each beam pair 224, 226, 228, 230, 232, 234 contacting the blade at the same time increases the amount of insertion force. The staggered configuration corresponds with at least one of the beam pairs 228, 230 being offset relative to a forward or a blade insertion end of the other beam pairs 224, 226, 232, 234. The offset can be helpful in reducing and/or controlling the amount of insertion force required for inserting the male blade between the opposed beam pairs 224, 226, 228, 230, 232, 234 by limiting the number of beam pairs 224, 226, 228, 230, 232, 234 engaging the leading end of the male terminal at the same time. The present invention contemplates a scalable arrangement where the number of opposed beams 224, 226, 228, 230, 232, 234 can be increased simply by cutting more beam legs from a sheet of material since each successive 224, 226, 228, 230, 232, 234 may be a replication of a single pair designed to a set of engineering criteria, i.e., if the mechanical integrating of one pair is sufficient then that pair can be replicated.

Figure 8A:
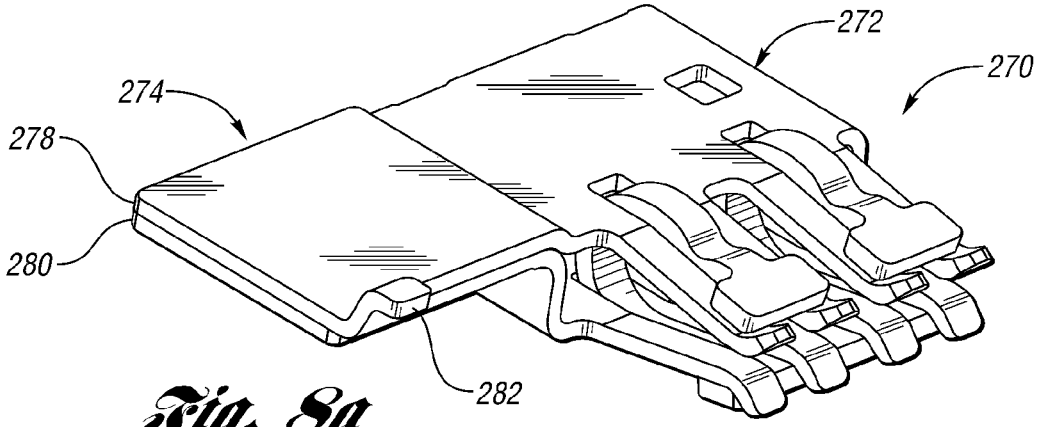
FIGS. 8*a*-8*b* illustrate a wave-shaped terminal assembly in accordance with one non-limiting aspect of the present invention.
Figure 8B:
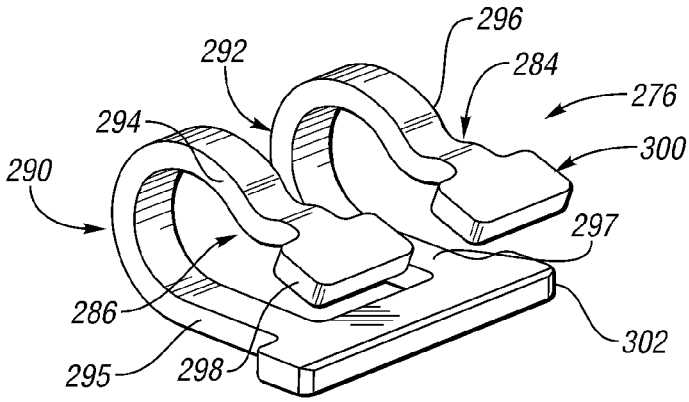

FIGS. 8*a*-8*b* illustrate a terminal assembly 270 with a terminal 272 having an angled terminal area 274 and a wave-shaped clamping member 276. The angled terminal area 274 may be formed in a manner similar to that described above such that top and bottom portions 278, 280 come together to provide a connector mounting surface. The angled terminal area 274 is also shown to include a protrusion 282, which may be used to facilitate an electrical connection or position of the terminal. The clamping member 276 is shown to include a wave-shaped alignment portion 284, 286 between a base 290, 292 and leading end of a top two of the two pairs of opposing clamping legs 294, 295, 296, 297 (a similar design can be support with a clamping member having only one pair of opposing clamping legs). The top two legs 294, 296 are also shown to include lateral extension alignment portions 298, 300 and bottom two legs 295, 297 are shown to include a cross member alignment portion 302. These alignment portions 298, 300, 302 may cooperate to facilitate position of the clamping member 274 within the terminal 218.

As supported above a terminal is disclosed. The terminal may include a base terminal and a spring clip assembled together. The terminal may include multiple contact beams made of highly conducted alloy (for example C151, C102, or similar). One side of the terminal may include a single layer/wire interface area having a vertical rib for mechanical rigidity/reinforcement, where the rib may also include a cross-section for electrical performance and to guide wire positioning during welding. Another design of the terminal may include features to facilitate mounting/attaching the terminal directly to a PC board, such as by using a straight leg stamped terminal body that allows the legs to be attached to the PC board using soldering. An optimum leg cross-section can be calculated by taking a total cross-section of all the beams and dividing by a number of legs.

One design of the terminal may include an attachment feature having straight legs that can be shaped as eyelets or needle eyes to facilitate connection through the PCB. The contact spring can be made of an alloy with high springiness (e.g., stainless steel 301). The spring clip may include a spring member pad per each contact beam with each pair of pads connected to opposite sides of a pair of beams. The contact springs may be configured to provide high normal force, particular with respect to high temperature situations with wires that are mechanically and/or electrically connected to the terminal to provide maximum current surface and maximum current carrying capacity in high temperature environments. The wires can be attached to the terminal by welding, crimping or other operations. The wires can be welded to the terminal in multiple directions and can have strands split and welded to each side of the terminal. Also, a busbar can be used instead of the wire strands and soldered to or compressed between the beams to establish connection to the terminal.

The first clamp-like member may be made of stainless steel which has low relaxation properties at elevated temperatures. As a result, the first clamp-like member may prevent the respective terminal legs from relaxing at elevated temperatures which would otherwise reduce the contact area with an associated blade terminal. As a result, the need for utilizing a copper alloy or similar substitute of material with lesser conductive properties is not necessary since relaxation has been minimized.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A female terminal for an electrical connector for connecting to a male blade terminal comprising:

at least one or more pairs of opposing beams for compressing against the male blade terminal with a first compressive force, each adjoining pair of opposing beams defining a recess therebetween; and a clamping member positioned at least partially within each recess to apply a second compressive force to the adjoining pair of opposing beams, the second compressive force adding to the first compressive force to create a third compressive force, the clamping member having at least one alignment portion configured to facilitate positioning within the recesses;

wherein the at least one alignment portion creates a wave-shape within the clamping member, the wave-shape having a trough extending below an outer surface of the adjoining pair of opposing beams.

2. The female terminal of claim 1 wherein the clamping member includes at least one pair of opposing legs joined at one end to a base with the wave-shape being positioned between the base and an opposite leading end.

3. The female terminal of claim 1 wherein the at least one alignment portion includes a first set of lateral extensions extending outwardly over the outer surface of the adjoining pair of opposing beams, the lateral extensions cooperating with the wave-shape to limit pitching and rotating of the clamping member.

4. The female terminal of claim 1 wherein the clamping member includes at least two pairs of opposing legs joined at one end to respective bases and a cross member connecting each pair, each pair having one leg connecting to the cross member and one leg not connecting to the cross member.

5. The female terminal of claim 1 having at least two pairs of opposing beams wherein at least one of the at least two pairs of opposing beams is staggered relative to the other of the at least two pairs of opposing beams.

6. The female terminal of claim 1 wherein the third compressive force is sufficient to cause a forward end of each pair of opposing beams to touch in the absence of the male blade terminal, the opposing beams not touching when subjected only to the first compressive force in the absence of the male blade terminal.

7. The female terminal of claim 1 wherein the opposing beams have a first metallic composition and the clamping member has a second metallic composition, wherein the first metallic composition has a higher conductivity than the second metallic composition.

8. The female terminal of claim 7 wherein the second metallic composition has a higher relaxation temperature than the first metallic composition.

9. The female terminal of claim 1 wherein the at least one alignment portion includes a lance that extends downwardly into the recess at least a first distance below an outer surface of the adjoining pair of opposing beams to limit rotating.

10. The female terminal of claim 9 wherein the lance is wave-shaped.

11. The female terminal of claim 9 wherein the at least one alignment portion includes a first set of lateral extensions extending outwardly relative to the lance over the outer surface of the adjoining pair of opposing beams.

12. The female terminal of claim 1 wherein the opposing beams extend in the same direction from a body portion, the body portion defining a cavity between opposed top and bottom sides space apart relative to opposed lateral sides, the opposing beams connecting exclusively to the top and bottom sides.

13. The female terminal of claim 12 further comprising a terminal area having top and bottom terminals extending from the body portion for connection to a conducting element, the opposing beams, body portion, top terminal and bottom terminal being formed from a single sheet of folded metal.

14. The female terminal of claim 13 wherein the top terminal is mechanically and electrically bonded to the bottom terminal with at least one of a clinch and a weld.

15. The female terminal of claim 13 wherein the top and bottom terminals extend over top of each other at a right angle from the body portion defined relative to the opposing beams.

16. An electrical connector comprising:

at least one or more pairs of opposing legs extending from a body portion, each leg having a substantially equal thickness and sloping inwardly relative to an outer perimeter of the body portion to a contact point where an inner surface of each opposing leg contact; and a spring clip attached over an outer surface of each opposing leg to increase a compressive force between opposing legs, wherein the spring clip includes a wave-shaped lance extending inwardly relative to an outer surface of adjoining pairs of opposing legs to limit spring clip rotation;

wherein the legs extending in the same direction from a body portion, the body portion defining a cavity between opposed top and bottom sides space apart relative to opposed lateral sides, beams connecting exclusively to the top and bottom sides;

a terminal area having top and bottom contact surfaces extending form the body portion for connection to a mating terminal; and wherein the top and bottom contact surfaces extend over top of each other at a right angle from the body portion defined relative to the opposing beams.

* * * * *

UNITED STATES PATENT AND TRADEMARK OFFICE

CERTIFICATE OF CORRECTION

PATENT NO. : 8,475,220 B2
APPLICATION NO. : 13/296534
DATED : July 2, 2013
INVENTOR(S) : Michael Glick et al.

It is certified that error appears in the above-identified patent and that said Letters Patent is hereby corrected as shown below:

In the Claims:

Column 9, Line 10, Claim 12:

After "bottom sides," delete "space" and
Insert -- spaced --.

Column 10, Line 15, Claim 16:

After "bottom sides," delete "space" and
Insert -- spaced --.

Column 10, Line 19, Claim 16:

After "contact surfaces extending" delete "form" and
Insert -- from --.

Signed and Sealed this
Eighteenth Day of March, 2014

Michelle K. Lee

Michelle K. Lee
*Deputy Director of the United States Patent and Trademark Office*